US011970921B2

(12) United States Patent
Rothnie et al.

(10) Patent No.: US 11,970,921 B2
(45) Date of Patent: Apr. 30, 2024

(54) DOWNHOLE SEALING APPARATUS AND METHOD

(71) Applicant: Rubberatkins Limited, Aberdeen (GB)

(72) Inventors: Stuart Rothnie, Aberdeen (GB); Keith Gaskin, Aberdeen (GB)

(73) Assignee: Rubberatkins Limited, Aberdeen (GB)

( * ) Notice: Subject to any disclaimer, the term of this patent is extended or adjusted under 35 U.S.C. 154(b) by 10 days.

(21) Appl. No.: 17/675,385

(22) Filed: Feb. 18, 2022

(65) Prior Publication Data

US 2022/0268124 A1 Aug. 25, 2022

(30) Foreign Application Priority Data

Feb. 19, 2021 (GB) ..... 2102393

(51) Int. Cl.

| | |
|---|---|
| ***E21B 33/12*** | (2006.01) |
| ***E21B 33/10*** | (2006.01) |
| ***E21B 33/128*** | (2006.01) |
| ***E21B 47/09*** | (2012.01) |

(52) U.S. Cl.

CPC ..... *E21B 33/1208* (2013.01); *E21B 33/10* (2013.01); *E21B 33/128* (2013.01); *E21B 33/1285* (2013.01); *E21B 47/09* (2013.01)

(58) Field of Classification Search

CPC ..... E21B 33/1208; E21B 33/10; E21B 33/12; E21B 33/128; E21B 33/1285; E21B 33/126

See application file for complete search history.

(56) References Cited

U.S. PATENT DOCUMENTS

2012/0132438 A1 5/2012 Telfer
2014/0251616 A1* 9/2014 O'Rourke ..... E21B 33/1208 166/55.7

FOREIGN PATENT DOCUMENTS

WO 2013062566 A1 5/2013

* cited by examiner

*Primary Examiner* — Tara Schimpf
*Assistant Examiner* — Jennifer A Railey
(74) *Attorney, Agent, or Firm* — Dinsmore & Shohl LLP

(57) ABSTRACT

A downhole sealing apparatus having a sealing assembly with one or more seal elements configured to engage a bore wall or bore-lining tubular wall to seal an annulus between the apparatus and the wall or tubular wall. A bypass arrangement is configured to provide selective bypass of the sealing assembly and the sealing apparatus is reconfigurable between a first configuration permitting bypass of the sealing assembly and a second configuration in which the bypass arrangement prevents or restricts bypass of the sealing assembly. A downhole method provides the downhole sealing apparatus within a bore hole, with the downhole sealing apparatus reconfigured from the first configuration in which the bypass arrangement permits bypass of the sealing assembly to a second configuration in which the bypass arrangement prevents or restricts bypass of the sealing assembly.

18 Claims, 4 Drawing Sheets

DOWNHOLE SEALING APPARATUS AND METHOD

CROSS-REFERENCE TO RELATED APPLICATIONS

This Application claims priority from Application 2102393.2 filed on Feb. 19, 2021 in the United Kingdom.

FIELD OF THE INVENTION

The present disclosure relates to a downhole sealing apparatus and method.

BACKGROUND OF THE INVENTION

Sealing assemblies are used extensively in the oil and gas industry for sealing an annulus in a wellbore, such as may exist between a mandrel and a bore wall or bore-lining tubular wall. Typically, sealing is achieved by the use of annular components which are mounted on the mandrel and which extend between the mandrel and the bore wall or bore-lining tubular wall. Such annular sealing components may take a variety of forms, including annular sealing bands, cup seals, inflatable bladders, swellable elements and the like.

In some cases, the sealing assemblies are activated to form the seal between the bore wall or bore-lining tubular wall and the mandrel, for example by the application of flow rate or a pressure differential to the seal assembly. This may be achieved, for example, through control of an applied flow rate to the seal assembly. When running a cup sealing assembly downhole, the cup sealing assembly typically has to be run in slowly in order to prevent accidental activation. Alternatively, this may be achieved by pumping fluid down the annulus in order to balance the pressure.

There remains drawbacks with existing sealing assemblies, for example the accidental activation of the sealing assembly.

SUMMARY OF THE INVENTION

Aspects of the present disclosure relate to a downhole sealing apparatus and method.

According to a first aspect, there is provided a downhole sealing apparatus comprising:

a sealing assembly comprising one or more seal elements configured to engage a bore wall or bore-lining tubular wall so as to seal an annulus between the downhole sealing apparatus and said bore wall or bore-lining tubular wall; and a bypass arrangement configured to provide selective bypass of the sealing assembly, wherein the downhole sealing apparatus is reconfigurable between a first configuration in which the bypass arrangement permits bypass of the sealing assembly and a second configuration in which the bypass arrangement prevents or restricts bypass of the sealing assembly.

In use, the bypass arrangement allows a nominal pressure difference to bypass the sealing assembly when the sealing apparatus is in the first configuration, and the sealing assembly may only be activated to form a seal when the sealing apparatus is in the second configuration.

Beneficially, the bypass arrangement may prevent undesired activation of the sealing assembly while sealing apparatus is in the first configuration. Therefore, the bypass arrangement may provide more control over the activation of the sealing assembly. For example, pressure-activated sealing assemblies by necessity are typically not provided with a means of bypassing pressure from a pressurised side to a non-pressured side of the sealing assembly. This normally means that the sealing assembly can be pressurised and activated when subject to any pressure. However, this also means that in some circumstances, the sealing assembly can be in-advertency activated and this may result in damage to the sealing assembly. This could occur, for example, if the sealing assembly is run in hole too quickly. The claimed downhole sealing apparatus allows a nominal pressure difference to bypass the sealing assembly via the bypass arrangement and thus prevent accidental activation of the sealing assembly.

The downhole sealing apparatus may comprise a mandrel. The mandrel may for example form part of a downhole tool, or may form part of a sub.

The downhole sealing apparatus may be reconfigurable from the first configuration to the second configuration by movement of the sealing assembly. For example, by movement of the sealing assembly relative to the mandrel.

The sealing assembly may comprise a pressure-activated sealing assembly. The sealing assembly may comprise a cup sealing assembly.

The one or more seal elements may be configured to be moveable from a radially retracted to a radially extended position. In the radially extended position, the one or more sealing elements may engage a bore wall or bore-lining tubular wall so as to seal an annulus between the downhole sealing apparatus and said bore wall or bore-lining tubular wall.

The sealing assembly may include a central bore to facilitate mounting of the sealing assembly on a mandrel.

The sealing assembly may be configured to be movable relative to the mandrel to reconfigure the downhole sealing apparatus from the first configuration to the second configuration. For example, in use, the sealing assembly may be configured to move when subject to a pressure differential. The sealing assembly may be configured to move in response to an applied pressure, or an applied flow rate. Movement of the sealing assembly may be fluid actuated. The sealing assembly may be axially moveable relative to the mandrel.

In use, the sealing assembly may form a piston wherein an applied flow rate moves the sealing assembly relative to the mandrel to reconfigure the sealing apparatus from the first configuration to the second configuration.

The sealing assembly may comprise a support member. The support member may define a central bore to accommodate a mandrel there through. The support member may be configured for sealing engagement with a mandrel. The support member may be configured for sealing engagement with the bypass arrangement. The support member may comprise an annular groove configured to receive a seal. For example, the seal may comprise an o-ring.

The bypass arrangement may define a through-bore for mounting of the bypass arrangement on a mandrel. The bypass arrangement may comprise a sleeve. The provision of a bypass sleeve would allow the bypass arrangement to be used with any number of sealing assemblies. Alternatively, the bypass arrangement may be formed in a mandrel.

The bypass arrangement may comprise a fluid passage. When the sealing apparatus is in the first configuration, fluid may flow through the fluid passage. When the sealing apparatus is in the second configuration, the fluid passage may be closed. The fluid passage may comprise for example a slot or conduit. Where the bypass arrangement is formed in a mandrel, the mandrel may comprise the at least one fluid passage. The bypass arrangement may comprise a plurality of fluid passages. The provision of a fluid passage or a plurality of fluid passages may mean that fluid is able to pass through the sealing apparatus when the sealing apparatus is in the first configuration. The size of the fluid passage or fluid passages may be selected such that the volume of fluid able to flow through the fluid passage or fluid passages may be relatively small compared to an applied flow rate. This may ensure that there is a nominal effect on other operations.

The fluid passage may comprise a first end and a second end. The first and second ends of the fluid passage may straddle the sealing assembly. In use, the first end may be in fluid communication with a first portion of the annulus and the second end may be in fluid communication with a second portion of the annulus. The first and second portions of the annulus are isolated when the one or more seal elements form a seal with the bore wall or bore-lining tubular wall. When the sealing apparatus is in the first configuration, the sealing assembly may be positioned to straddle the fluid passage such that the fluid passage is open. When the sealing apparatus is in the second configuration, the fluid passage is configured to be closed. When the sealing apparatus is in the second configuration, the sealing assembly may be positioned to straddle the fluid passage such that the fluid passage is closed.

The bypass arrangement may comprise a biasing mechanism. The biasing mechanism may comprise, for example, a spring. The spring may comprise, for example, at least one disc spring, at least one Bellville washer or the like. The biasing mechanism may be configured to bias the sealing apparatus to the first configuration. Providing a biasing mechanism that is biased to the first configuration may simplify the operation of the downhole sealing apparatus. This may also prevent accidental activation of the sealing assembly until the sealing apparatus is reconfigured to the second configuration. In use, the sealing assembly may be configured to exert a force on the biasing mechanism to reconfigure the sealing apparatus from the first to the second configuration. Reconfiguration of the downhole sealing apparatus may therefore be selected by selecting the spring force.

The bypass arrangement may comprise a radially extending flange. The biasing mechanism may be positioned adjacent to the radially extended flange. In use, the biasing mechanism may be positioned between the sealing assembly and the radially extended flange.

The downhole sealing apparatus may comprise a second sealing assembly. The second sealing assembly may be arranged to be positioned back-to-back with the sealing assembly. The provision of back-to-back sealing assemblies may be useful for operations in which downhole pressure is to be held in both directions downhole.

The bypass arrangement may be positioned in between the sealing assembly and the second sealing assembly and may be operable to selectively bypass one or both of the sealing assembly and the second sealing assembly.

Alternatively, the downhole apparatus may comprise a further bypass arrangement configured to provide selective bypass of the second sealing assembly.

According to a second aspect, there is also provided a downhole sealing method comprising:

providing a downhole sealing apparatus according to the first aspect within a borehole; and reconfiguring the downhole sealing apparatus from the first configuration in which the bypass arrangement of the first aspect permits bypass of the sealing assembly of the first aspect to a second configuration in which the bypass arrangement prevents or restricts bypass of the sealing assembly.

The method may comprise locating the downhole sealing apparatus within a borehole.

The method may further comprise applying a differential pressure to the downhole sealing apparatus to reconfigure the sealing apparatus from the first configuration to the second configuration. The pressure differential required to reconfigure the sealing apparatus from the first configuration to the second configuration may be selected according to operational requirements.

The method may comprise activating the sealing assembly to form a seal with a bore wall or bore-lining tubular wall when the sealing apparatus in in the second configuration.

According to a further aspect, there is provided a downhole sealing apparatus comprising a sealing assembly. The sealing apparatus may comprise one or more seal elements. The one or more seal elements may be configured to engage a bore wall or bore-lining tubular wall so as to seal an annulus between the downhole sealing apparatus and said bore wall or bore-lining tubular wall. The apparatus may further comprise a bypass arrangement configured to provide selective bypass of the sealing assembly. The downhole sealing apparatus may be reconfigurable between a first configuration in which the bypass arrangement permits bypass of the sealing assembly and a second configuration in which the bypass arrangement prevents or restricts bypass of the sealing assembly.

According to a further aspect, there is also provided a downhole sealing method comprising providing a downhole sealing apparatus within a borehole. The downhole sealing apparatus comprising a sealing assembly. The sealing apparatus may comprise one or more seal elements. The one or more seal elements may be configured to engage a bore wall or bore-lining tubular wall so as to seal an annulus between the downhole sealing apparatus and said bore wall or bore-lining tubular wall. The apparatus may further comprise a bypass arrangement configured to provide selective bypass of the sealing assembly. The method may comprise reconfiguring the downhole sealing apparatus from a first configuration in which the bypass arrangement permits bypass of the sealing assembly to a second configuration in which the bypass arrangement prevents or restricts bypass of the sealing assembly.

According to a further aspect, there is also provided a bypass arrangement for use with a sealing assembly. The bypass arrangement may comprise a fluid passage. The fluid passage may comprise a first end and a second end. In use, the first end and the second end may be configured to allow fluid communication between a first and a second portion of an annulus. The bypass arrangement may comprise a plurality of fluid passages. The bypass arrangement may define a sleeve for location on a mandrel.

The bypass arrangement may comprise a biasing mechanism. The biasing mechanism may be configured such that in use, the biasing mechanism biases a sealing apparatus to a first configuration. The biasing mechanism may comprise, for example, a spring. The spring may comprise, for example, at least one disc spring, at least one Bellville washer or the like.

For the purposes of the present disclosure, it should be understood that the features defined above or described below may be utilised, either alone or in combination with any other defined feature, in any other aspect, embodiment, or example or to form a further aspect, embodiment or example of the disclosure.

BRIEF DESCRIPTION OF THE DRAWINGS

These and other aspects of the present disclosure will now be described, by way of example only, with reference to the accompanying drawings in which.

Figure 1:
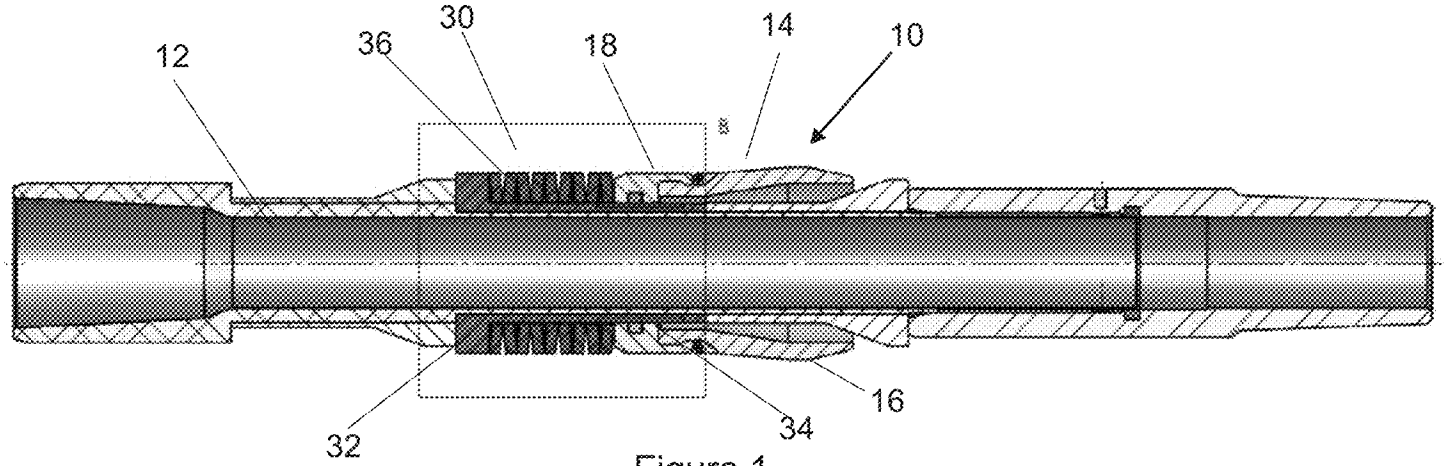
FIG. 1 is a longitudinal cross-sectional view of a downhole sealing apparatus on a mandrel with an open bypass arrangement.
Figure 2:
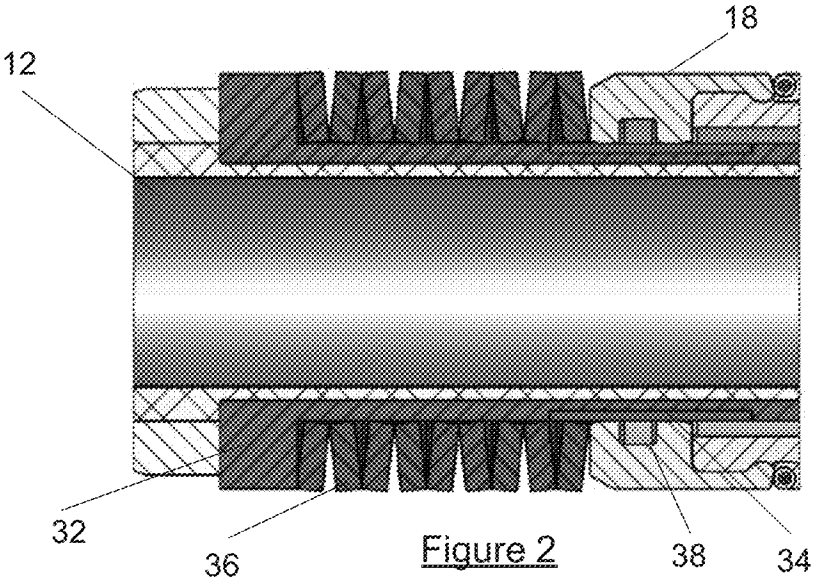
FIG. 2 is an enlarged view of the open bypass arrangement.

A downhole sealing apparatus 10 is shown in FIG. 1 of the accompanying drawings. The downhole sealing apparatus 10 comprises a sealing assembly, generally denoted 14, which in the illustrated apparatus 10 is in the form of a cup sealing assembly. The sealing assembly 14 comprises a sealing element 16 and a support member 18. The support member 18 may comprise a seal 38, for example an O-ring, which is provided in an annular groove in the support member 18. It will be appreciated that any form of sealing assembly may be utilised in the downhole sealing apparatus 10, particularly sealing assemblies which form a seal upon exposure to a pressure differential, such as cup sealing assemblies. The sealing assembly 14 is positioned on a mandrel 12 for location downhole.

The downhole apparatus 10 further comprises a bypass arrangement 30. The bypass arrangement 30 comprises a biasing mechanism in the form of a series of disc springs 36 which bias the downhole sealing apparatus to a first configuration in which the sealing assembly 14 can be bypassed. Any form of spring may be used in order to provide the desired biased arrangement. The bypass arrangement 30 comprises a flow passage 34 (in the form of a slot) wherein the flow passage permits fluid communication between a first portion of the annulus and a second portion of the annulus, when the sealing apparatus is located downhole. Multiple flow passages may be provided.

Figure 7:
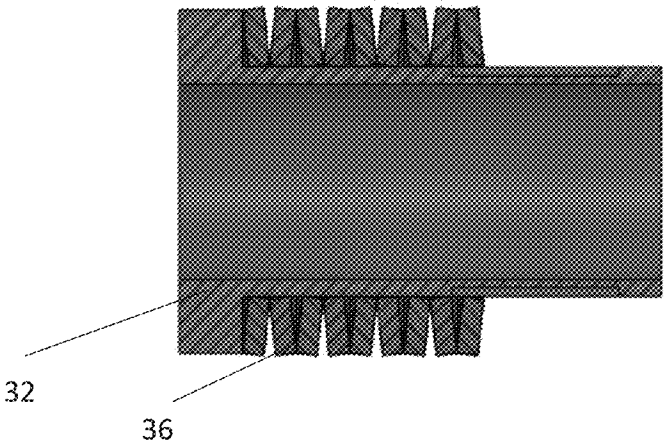
FIG. 7 is a cross-sectional view of a bypass arrangement.

The bypass arrangement comprises a radially outwardly extending flange 33. The biasing mechanism is configured to be positioned between the sealing assembly 14 and the flange 33. In some examples, the bypass arrangement comprises a bypass sleeve 32 configured for mounting on the mandrel 12 (FIG. 7). Alternatively, the bypass arrangement 30 may form part of the mandrel itself whereby the flow passages 34 are formed in the mandrel 12 (not shown).

In use, the downhole sealing apparatus 10 can be located downhole. Whilst running downhole, or prior to forming a seal using the sealing assembly 14, the bypass arrangement 30 biases the apparatus to the first configuration whereby a nominal pressure difference can bypass the sealing assembly 14 by virtue of the flow path provided through the flow passage 34. This prevents the accidental activation of the sealing assembly 14. For example, an issue with prior art sealing assemblies can occur when the assembly is run in hole too quickly resulting in a build-up of pressure which can accidently activate the sealing assembly and result in damage to the sealing assembly. The provision of the bypass arrangement, which permits the sealing assembly to be bypassed, should allow an operator to run the apparatus downhole without accidentally activating the sealing assembly.

Figure 3:
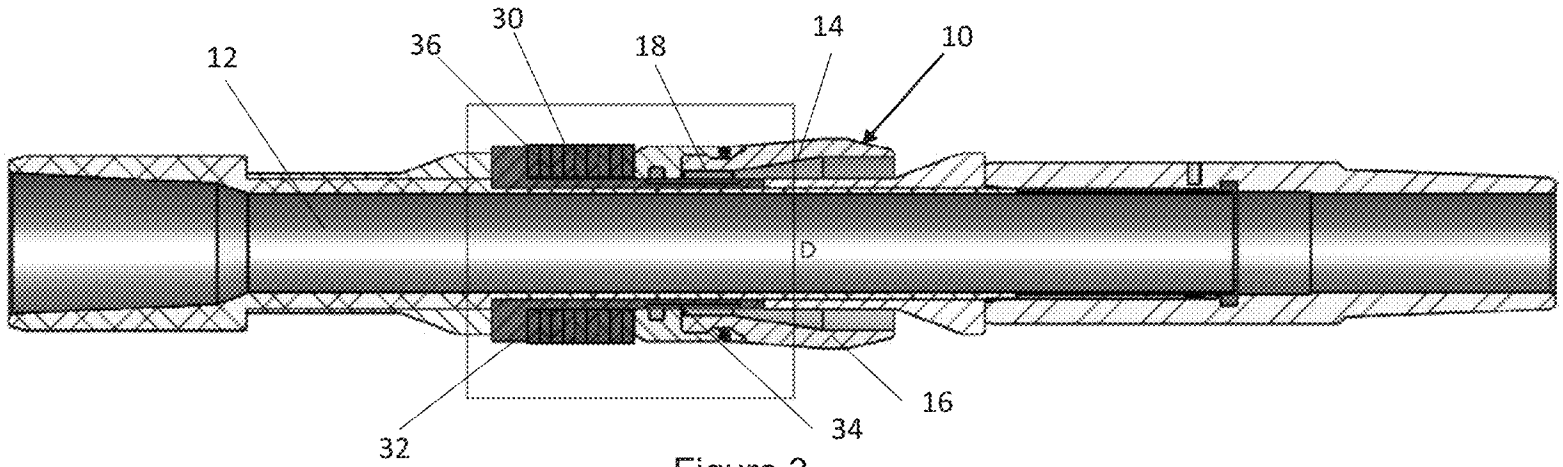
FIG. 3 is a cross-sectional view of a downhole sealing apparatus on a mandrel with a closed bypass arrangement.
Figure 4:
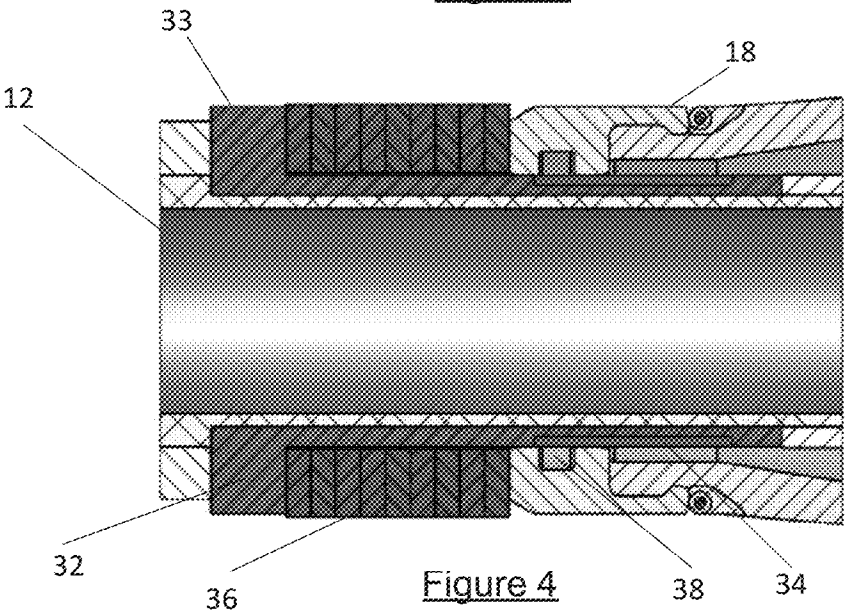
FIG. 4 is an enlarged view of the closed bypass arrangement.

When it is desired to activate the sealing assembly 14, a higher pressure differential may be applied to the downhole sealing apparatus 10, for example by increasing an applied flow rate. The increase in pressure differential axially moves the sealing assembly 14 relative to the mandrel to reconfigure the downhole sealing apparatus 10 into the second configuration (FIGS. 3 and 4) in which the bypass arrangement prevents bypass of the sealing assembly 14. Under the increased pressure differential, the sealing assembly 14 compresses the disc springs 36 of the bypass arrangement 30 and closes the flow passage 34. The pressure differential required to reconfigure the downhole apparatus from the first to the second configuration may be determined by operational requirements. For example, the pressure differential required may be the same or slightly less than the pressure differential required to activate the sealing assembly 14. The pressure differential required to reconfigure the downhole apparatus may be determined by the spring force of the disc springs 36 and/or the volume of the flow passage 34.

With the downhole sealing apparatus 10 in the second configuration, the sealing assembly 14 may be activated to form a seal with a bore wall. As shown in the figures, the sealing assembly 14 may be in the form of a cup sealing assembly, wherein the seal element 16 is configured to expand under a pressure differential to form a seal with a bore wall.

Figure 5:
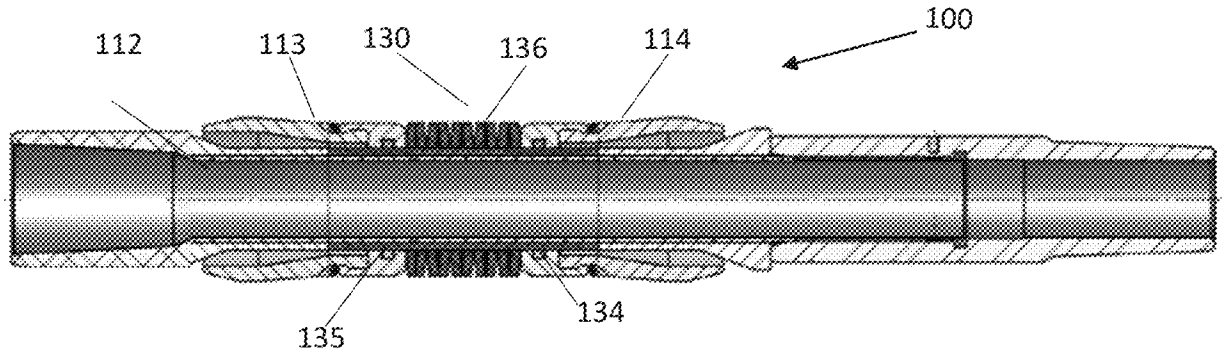
FIG. 5 is a cross-sectional view of a downhole sealing apparatus having multiple sealing assemblies.

A further downhole sealing apparatus 100 is shown in FIG. 5. The downhole apparatus 100 comprises a first sealing assembly 113 and a second sealing assembly 114 configured to be positioned on a mandrel 112 in a back-to-back arrangement. A bypass arrangement 130 is provided between the first and second sealing assemblies 113, 114. The disc springs 136 of the bypass arrangement 130 are biased to a first configuration in which flow passages 134, 135 are open to allow a nominal pressure differential to bypass the sealing assemblies 113, 114. The bypass arrangement 130 is configured such a differential pressure in at least one direction will move the respective sealing assembly 113, 114 to close the respective flow passage 134, 135 and prevent bypass of the sealing assembly 113, 114.

Figure 6:
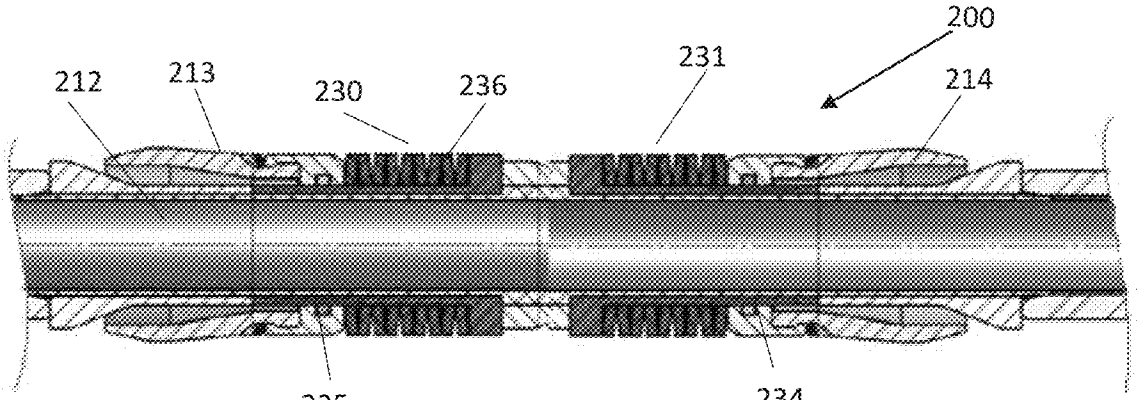
FIG. 6 is a cross-sectional view of a downhole sealing apparatus having multiple sealing assemblies and bypass arrangements.

A further downhole sealing apparatus 100 is shown in FIG. 6. The downhole apparatus 200 comprises a first sealing assembly 213 and a second sealing assembly 214 configured to be positioned on a mandrel 212 in a back-to-back arrangement. A first bypass arrangement 230 including disc springs 236 is arranged to provide selective bypass of the sealing assembly 213 via flow passage 235 and a second bypass arrangement 231 including disc springs is arranged to provide selective bypass of the sealing assembly 214 via flow passage 234.

It should be understood that the examples provided herein are merely exemplary of the present disclosure and that various modifications may be made thereto without departing from the scope defined by the claims.

The invention claimed is:

1. A downhole sealing apparatus configured to engage a bore wall or bore-lining tubular wall so as to seal an annulus between the downhole sealing apparatus and said bore wall or bore-lining tubular wall, and wherein the downhole sealing apparatus comprises:

a sealing assembly, wherein the sealing assembly comprises one or more seal elements configured to engage the bore wall or bore-lining tubular wall so as to seal the annulus between the downhole sealing apparatus and said bore wall or bore-lining tubular wall; and a bypass arrangement configured to provide selective bypass of the sealing assembly, wherein the bypass arrangement comprises a fluid passage formed in a mandrel or sleeve, wherein the downhole sealing apparatus is reconfigurable between a first configuration in which the bypass arrangement permits bypass of the sealing assembly and a second configuration in which the bypass arrangement prevents or restricts bypass of the sealing assembly, wherein the downhole sealing apparatus is reconfigurable from the first configuration to the second configuration by movement of the sealing assembly, and wherein said one or more seal elements configured to engage the bore wall or bore-lining tubular wall are axially movable relative to said mandrel or sleeve between a first position when the downhole sealing apparatus is in said first configuration and a second position when the downhole sealing apparatus is in said second configuration.

2. The downhole sealing apparatus of claim 1, wherein the sealing assembly comprises a pressure-activated sealing assembly.

3. The downhole sealing apparatus of claim 1, wherein the fluid passage comprises a first end and a second end, and the bypass arrangement is positioned such that the first and second ends of the fluid passage straddle the sealing assembly in the first configuration.

4. The downhole sealing apparatus of claim 1, wherein the bypass arrangement further comprises a biasing mechanism.

5. The downhole sealing apparatus of claim 4, wherein the biasing mechanism is configured to bias the sealing apparatus to the first configuration.

6. The downhole sealing apparatus of claim 4, wherein the biasing mechanism comprises a spring.

7. The downhole sealing apparatus of claim 4, wherein the biasing mechanism is configured for location around an outer surface of the mandrel or sleeve.

8. The downhole sealing apparatus of claim 1, further comprising a second sealing assembly.

9. The downhole sealing apparatus of claim 8, wherein the second sealing assembly is arranged to be back-to-back with the sealing assembly.

10. The downhole sealing apparatus of claim 8, wherein the bypass arrangement is positioned in between the sealing assembly and the second sealing assembly and is operable to selectively bypass one or both of the sealing assembly and the second sealing assembly.

11. The downhole sealing apparatus of claim 8, further comprising a second bypass arrangement configured to provide selective bypass of the second sealing assembly.

12. The downhole sealing apparatus of claim 1, wherein the sealing assembly further comprises a support member.

13. The downhole sealing apparatus of claim 12, wherein the support member defines a central bore configured to accommodate the mandrel therethrough.

14. The downhole sealing apparatus of claim 12, wherein the support member is configured for sealing engagement with the bypass arrangement.

15. A downhole method comprising the steps of:

providing a downhole sealing apparatus according to claim 1 within a borehole; and reconfiguring the downhole sealing apparatus from the first configuration in which the bypass arrangement permits bypass of the sealing assembly to the second configuration in which the bypass arrangement prevents or restricts bypass of the sealing assembly.

16. The method of claim 15, further comprising the step of locating the downhole sealing apparatus downhole.

17. The method of claim 15, comprising the step of applying a differential pressure to the downhole sealing apparatus to reconfigure the sealing apparatus from the first configuration to the second configuration.

18. The method of claim 15, further comprising the step of activating the sealing assembly to form a seal with a bore wall when the bypass arrangement is in the second configuration.

* * * * *